US007653964B2

(12) United States Patent
Kwon et al.

(10) Patent No.: US 7,653,964 B2
(45) Date of Patent: Feb. 2, 2010

(54) APPARATUS FOR ADJUSTING HEIGHT OF SUCTION BRUSH

(75) Inventors: Oh-Kyu Kwon, Goyang-si (KR); Tae-gwang Kim, Incheon (KR); Jeong-hee Cho, Jeonju-si (KR)

(73) Assignee: Samsung Gwangju Electronics Co., Ltd., Gwanju (KR)

( * ) Notice: Subject to any disclaimer, the term of this patent is extended or adjusted under 35 U.S.C. 154(b) by 234 days.

(21) Appl. No.: 11/544,656

(22) Filed: Oct. 10, 2006

(65) Prior Publication Data

US 2007/0220701 A1 Sep. 27, 2007

(30) Foreign Application Priority Data

Mar. 24, 2006 (KR) ..... 10-2006-0026866

(51) Int. Cl.
*A47L 5/34* (2006.01)

(52) U.S. Cl. ..... 15/354; 15/368

(58) Field of Classification Search ..... 15/362, 15/354, 333, 368; 74/553; 16/414, 441
See application file for complete search history.

(56) References Cited

U.S. PATENT DOCUMENTS 5,974,625 A * 11/1999 Garner ..... 15/354
2004/0211027 A1* 10/2004 Park et al. ..... 15/354
2005/0210625 A1* 9/2005 Joung et al. ..... 15/390

FOREIGN PATENT DOCUMENTS

GB 240788 4/1926

OTHER PUBLICATIONS

United Kingdom Intellecutal Property Office, Combined Search and Examination Report issued Feb. 20, 2007, with respect to United Kingdom Patent Application No. 0622690.6, filed on Nov. 14, 2006.

* cited by examiner

*Primary Examiner*—Dung Van Nguyen
(74) *Attorney, Agent, or Firm*—Blank Rome LLP

(57) ABSTRACT

An apparatus for adjusting a height of a suction brush for use in a vacuum cleaner includes a height adjusting knob rotatably disposed in an inserting recess formed in the suction brush, and having an inclined part formed thereon, so that a height of the suction brush from a surface to be cleaned is varied as a position of the height adjusting knob rotated, a supporting member to support the suction brush in contact with the inclined part thus to allow the suction brush to be ascended and descended by the inclined part, and a passage disposed between an inner circumferential surface of the inserting recess and an outer circumferential surface of the height adjusting knob to pass fine dirt therethrough. With the passage, the fine dirt is not tied up between the inner circumferential surface of the inserting recess and the outer circumferential surface of the height adjusting knob. Accordingly, the rotation of the height adjusting knob is not restricted or obstructed due to the fine dirt.

8 Claims, 6 Drawing Sheets

APPARATUS FOR ADJUSTING HEIGHT OF SUCTION BRUSH

BACKGROUND OF THE INVENTION

1. Field of the Invention

The present invention relates to a vacuum cleaner, and more particularly, to an apparatus for adjusting a distance between a suction brush and a surface to be cleaned, i.e., a height of the suction brush from the surface to be cleaned.

2. Description of the Related Art

A general vacuum cleaner includes a cleaner body in which a motor is installed to generate a suction force, and a suction brush disposed at a bottom of the cleaner body to face a surface to be cleaned.

The suction brush is provided with a brush member, which cleans dirt from the surface to be cleaned while being rotated by the suction force generated in the cleaner body. As the brush member, one selected from a fur brush and a duster brush may be employed.

According to the vacuum cleaner with the construction as described above, when the user moves the suction brush along the surface to be cleaned, the dirt on the surface to be cleaned is taken in the cleaner body by the suction force generated therein, and thus the surface to be cleaned is cleaned.

On the other hand, the suction brush is provided with an apparatus for adjusting a distance between the suction brush and the surface to be cleaned, i.e., a height of the suction brush from the surface to be cleaned. Such a suction brush height adjusting apparatus includes a height adjusting knob rotatably disposed on the suction brush, and a supporting member to support the height adjusting knob.

According to the suction brush height adjusting apparatus, as the user rotates the height adjusting knob, the distance between the suction brush and the surface to be cleaned is adjusted.

Since the height adjusting knob is installed in an inserting hole or recess of the suction brush, to smoothly rotate the height adjusting knob, a predetermined space should be built between the height adjusting knob and the inserting hole or recess. Accordingly, during the cleaning operation, fine dirt, such as dust, may enter the space built between the height adjusting knob and the inserting hole or recess. If the entered dirt is not removed from the space, but tied up therein, a problem may occur, in that the rotation of the height adjusting knob is restricted due to the tied-up dirt.

SUMMARY OF THE INVENTION

An aspect of the present invention is to address at least the above problems and/or disadvantages and to provide at least the advantages described below. Accordingly, an aspect of the present invention is to provide an apparatus for adjusting a height of a suction brush for use in a vacuum cleaner, that a rotation of a height adjusting knob is not restricted or obstructed due to fine dirt, thereby being conveniently used.

According to an aspect of an exemplary embodiment of the present invention, an apparatus for adjusting a height of a suction brush for use in a vacuum cleaner includes a height adjusting knob, a supporting member, and a passage. The height adjusting knob is rotatably disposed in an inserting recess formed in the suction brush, and has an inclined part formed thereon, so that a height of the suction brush from a surface to be cleaned is varied as a position of the height adjusting knob rotated. The supporting member supports the suction brush in contact with the inclined part thus to allow the suction brush to be ascended and descended by the inclined part. The passage is disposed between an inner circumferential surface of the inserting recess and an outer circumferential surface of the height adjusting knob to pass fine dirt therethrough.

The passage may include a plurality of passing grooves formed in a spaced-apart relation to each other on the outer circumferential surface of the height adjusting knob.

Each of the passing grooves may be formed in a straight line from a top to a bottom thereof.

The height adjusting knob may include a flange to prevent the height adjusting knob from being removed from the inserting recess, and an operating part to rotate the height adjusting knob.

The passing grooves may be formed penetrating the flange.

The supporting member may be disposed on an axle supporting wheels that are provided for moving the suction brush.

The inclined part may have a plurality of click grooves formed in a spaced-apart relation to each other to regulate the rotation of the height adjusting knob.

BRIEF DESCRIPTION OF THE DRAWING FIGURES

The above aspects and other advantages of the present invention will be more apparent by describing an embodiment of the present invention with reference to the accompanying drawing figures, in which.

Throughout the drawings, the same drawing reference numerals will be understood to refer to the same elements, features, and structures.

DETAILED DESCRIPTION OF AN EXEMPLARY EMBODIMENT

The matters defined in the description such as a detailed construction and elements are provided to assist in a comprehensive understanding of the embodiment of the invention and are merely exemplary. Accordingly, those of ordinary skill in the art will recognize that various changes and modifications of the embodiment described herein can be made without departing from the scope and spirit of the invention. Also, descriptions of well-known functions and constructions are omitted for clarity and conciseness.

Figure 1:
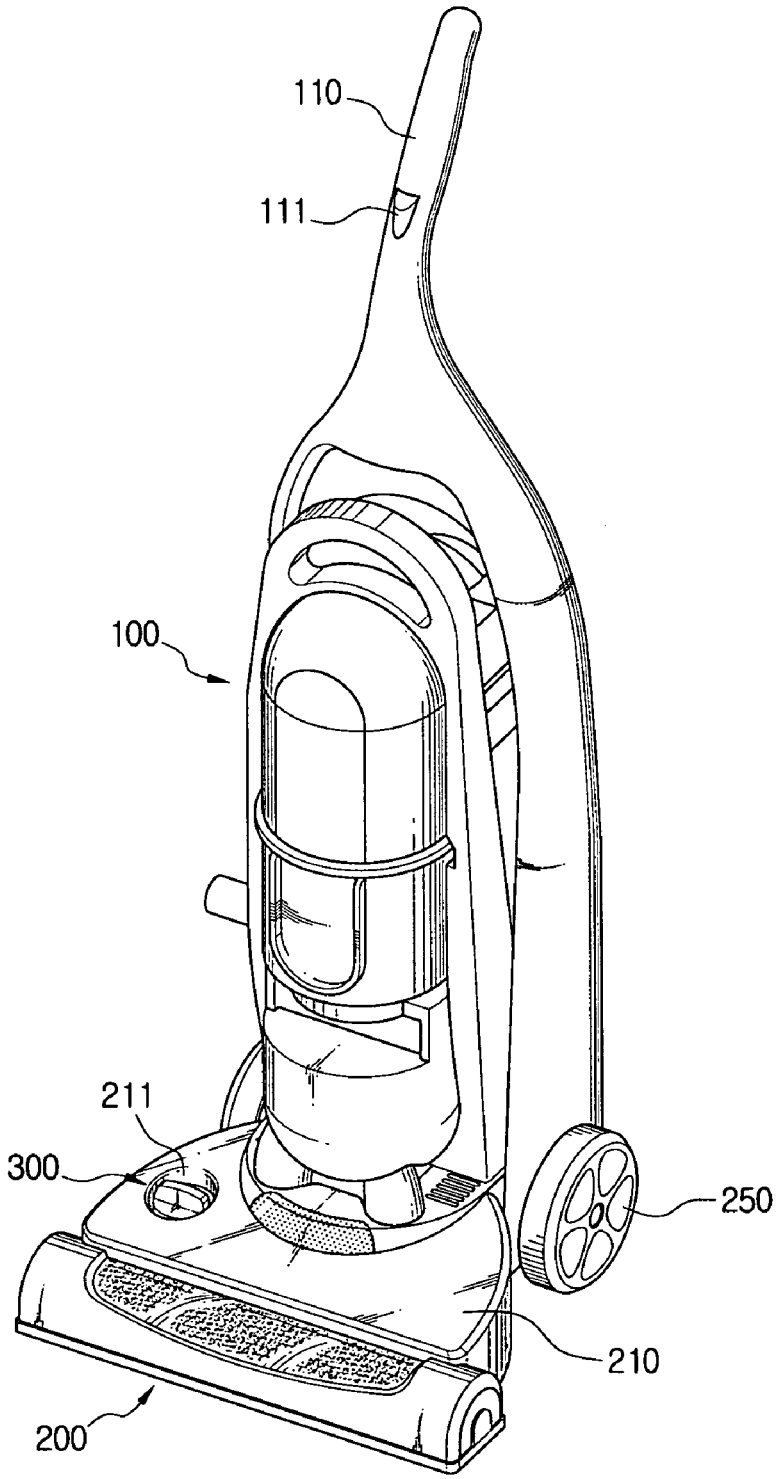
FIG. 1 is a schematic perspective view exemplifying a vacuum cleaner in which an apparatus for adjusting a height of a suction brush in accordance with an exemplary embodiment of the present invention is employed.

FIG. 1 is a schematic perspective view exemplifying an upright type vacuum cleaner to which an apparatus 300 for adjusting a height of a suction brush in accordance with an exemplary embodiment of the present invention is applied. In the drawing, a cleaner body is marked by a reference numeral 100, and a suction brush is marked by a reference numeral 200. A motor, a filter, etc., which are not illustrated in the drawing, are installed in the cleaner body 100. At an upper end of the cleaner body 100 is disposed a handle 110 on which a switch 111 is formed.

Figure 2:
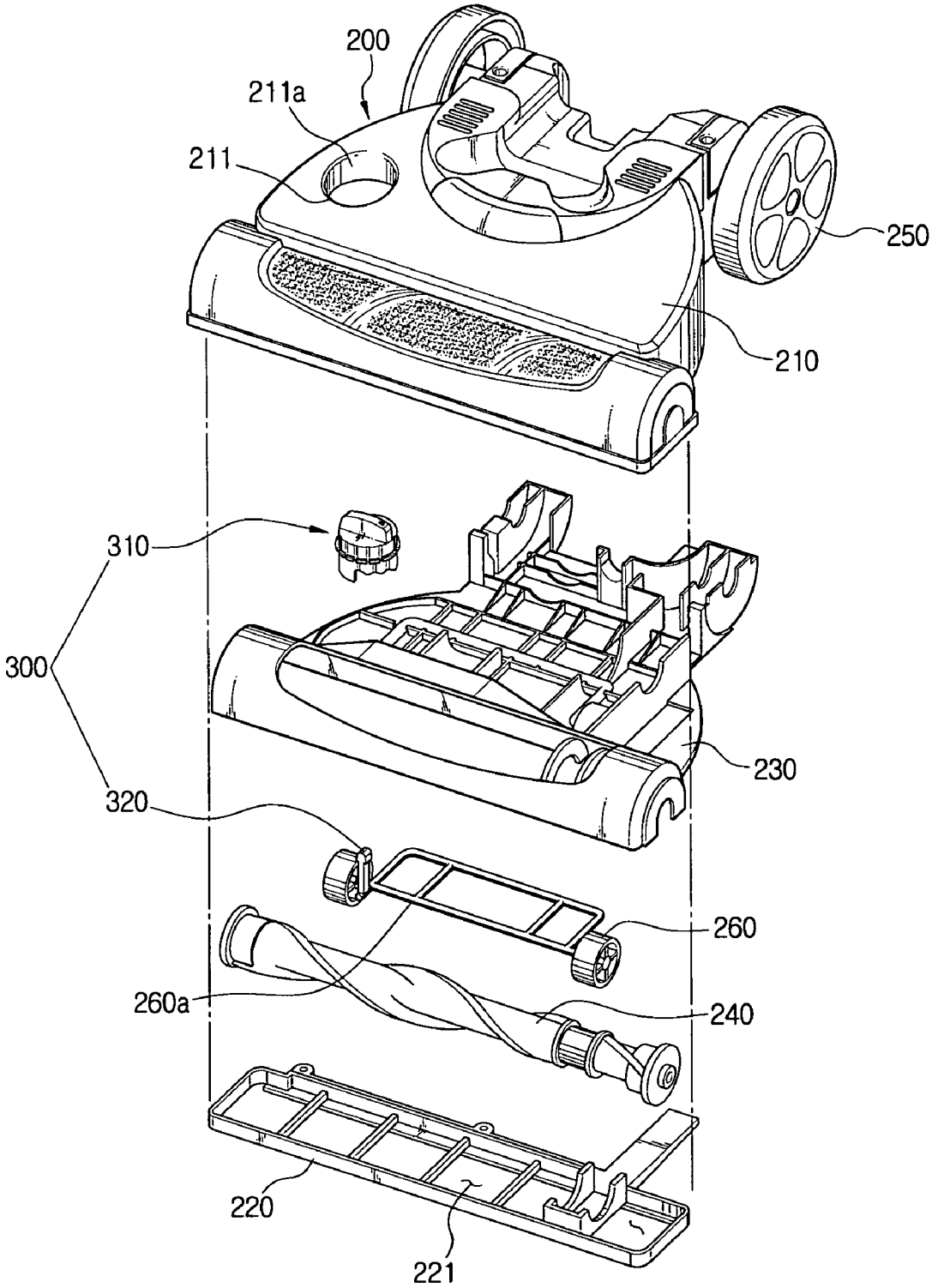
FIG. 2 is an exploded perspective view exemplifying only the suction brush of the vacuum cleaner of FIG. 1.

As illustrated in FIG. 2, the suction brush 200 includes upper and lower cover 210 and 220, a frame 230, a brush member 240, and first and second wheels 250 and 260.

In the upper cover 210 is formed an inserting hole or recess 211 for installing the suction brush height adjusting apparatus 300 in accordance with the exemplary embodiment of the present invention, which will be described below, and in the lower cover 220 is formed a suction port 221. The frame 230 supports inward parts of the suction brush 200, such as the brush member 240.

As the brush member 240, either a fur brush or a duster brush can be employed. In the exemplary embodiment, the brush member 240 is illustrated as a fur brush, which shakes dirt off by friction against a surface to be cleaned.

Such a brush member 240 is protruded to the outside through the suction port 221 of the lower cover 220, and is rotated by a suction force of the motor of the cleaner body 100, which is transmitted through a rotating means (not illustrated), such as a turbine.

The first and the second wheels 250 and 260 move the suction brush 200 during a cleaning operation. The first wheels 250 are supported to the upper cover 210, and the second wheels 260 are supported on an axle 260*a*.

Figure 3:
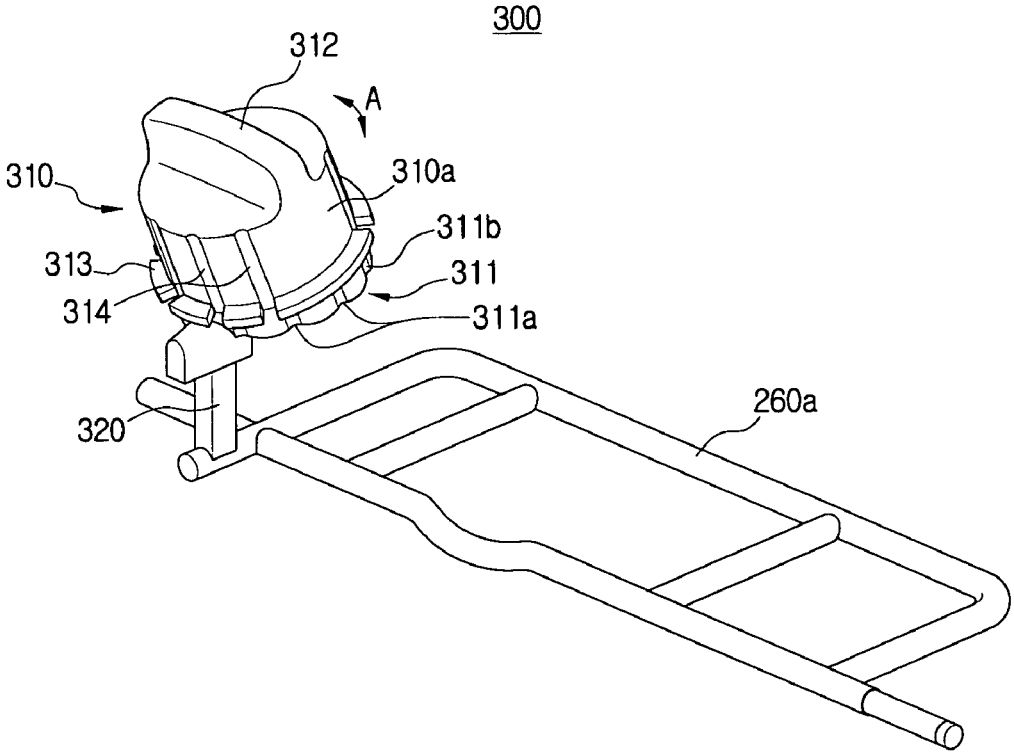
FIG. 3 is a perspective view exemplifying the suction brush height adjusting apparatus in accordance with the exemplary embodiment of the present invention.
Figure 4A:
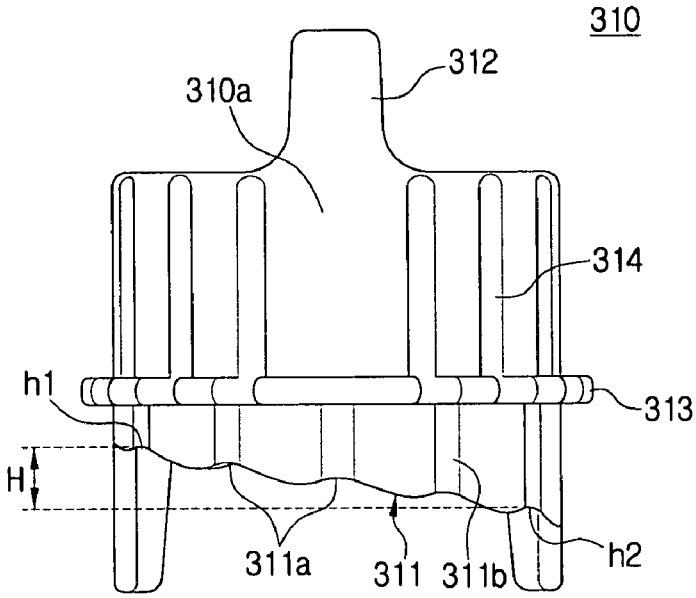
FIGS. 4A and 4B are a front view and a top plan view exemplifying a height adjusting knob of the suction brush height adjusting apparatus in accordance with the exemplary embodiment of the present invention.
Figure 4B:
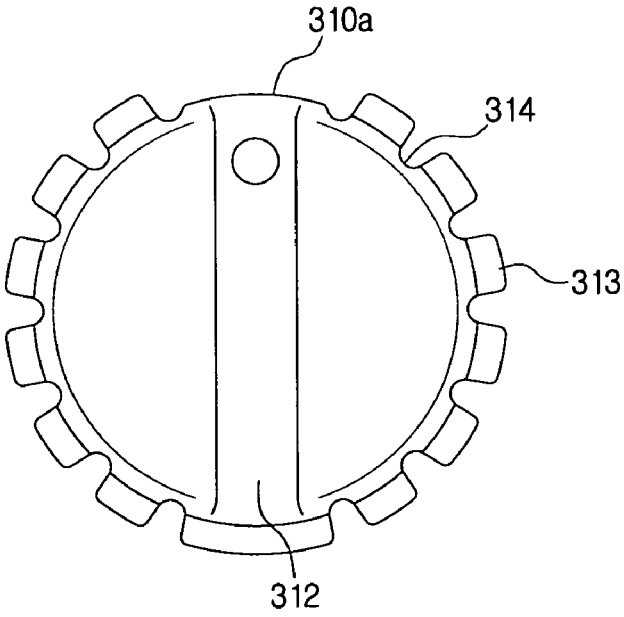
Figure 5:
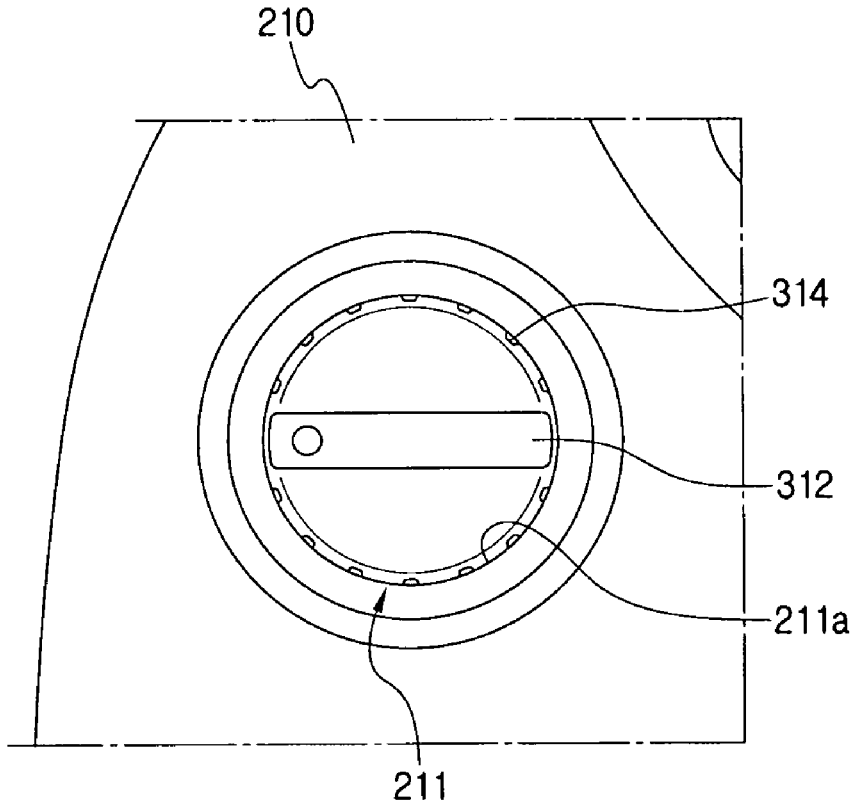
FIG. 5 is a top plan view exemplifying the suction brush height adjusting apparatus in accordance with the exemplary embodiment of the present invention in which the height adjusting knob is installed in an inserting recess.

As illustrates in FIGS. 3 through 5, the suction brush height adjusting apparatus 300 in accordance with the exemplary embodiment of the present invention includes a height adjusting knob 310 and a supporting member 320.

The height adjusting knob 310 is rotatably installed in the inserting hole or recess 211 of the upper cover 210, and is formed in a cylindrical shape, which is rotatable in both directions, e.g., directions of arrow A illustrated in FIG. 3. As illustrated in FIGS. 4A and 4B, the height adjusting knob 310 includes an inclined part 311, an operating part 312, a flange 313, and passing grooves 314.

As illustrated in FIG. 4A, the inclined part 311 is formed on an undersurface of the height adjusting knob 310 to have a predetermined difference H in height between a beginning point h1 and an end point h2, so that a height of the suction brush 200 from the surface to be cleaned is varied as a position of the height adjusting knob 310 rotated by user. Also, the inclined part 311 has a plurality of click grooves 311*a* formed thereon to regulate the rotating position of the height adjusting knob 310.

The height of the suction brush 200 from the surface to be cleaned, i.e., a distance between the suction brush 200 and the surface to be cleaned is adjusted by stages corresponding to the number of the click grooves 311*a*. For instance, as illustrated in FIG. 4A, if the number of the click grooves 311*a* is five, the distance between the suction brush 200 and the surface to be cleaned will be adjusted by 5 stages.

Preferably, the inclined part 311 is formed as much as approximately half of the area in the undersurface of the height adjusting knob 310, so that the height adjusting knob 310 is rotated by an angle of 180° from the beginning point h1 to the end point h2.

In addition, the inclined part 311 further includes fixing grooves 311*b* to fix the rotating position of the height adjusting knob 310. The fixing grooves 311*b* are formed on an outer circumferential surface 310*a* of the height adjusting knob 310, so that it is extended from the click grooves 311*a* to the flange 313 which will be described in details below. Here, preferably, fixing protrusions (not illustrated) are formed corresponding to the fixing grooves 311*b* on the upper cover 210 or the frame 230 to protrude therefrom.

The operating part 312 is formed at a top of the height adjusting knob 310, so that it is exposed to the outside through the inserting hole or recess 211. The operating part 312 has a shape, which can easily be gripped by user. In the exemplary embodiment, the operating part 312 is illustrated as an I-lettered shape. With the rotating operation of the operating part 312, the height adjusting knob 310 is rotated in directions of arrow A.

The flange 313 is protruded along the outer circumferential surface 310*a* of the height adjusting knob 310 to prevent the height adjusting knob 310 from escaping from the inserting hole or recess 211. The flange 313 is supported to an inner side of the upper cover 210.

As illustrated in FIGS. 4A through 5, to form a passage to pass fine dirt therethrough, passing grooves 314 are disposed between the outer circumferential surface 310*a* of the height adjusting knob 310 and an inner circumferential surface 211*a* of the inserting hole or recess 211. The passing grooves 314 are formed in a spaced-apart relation to each other on the outer circumferential surface 310*a* of the height adjusting knob 310.

The passing grooves 314 guide the fine dirt to move toward the lower cover 220 from the upper cover 210. For this, each of passing grooves 314 is formed in a straight line from a top to a bottom thereof.

As illustrated in FIG. 4B, the passing grooves 314 are formed to penetrate the flange 313. That is, the passing grooves 314 are formed on the outer circumferential surface 310*a* of the height adjusting knob 310 separately from the fixing grooves 311*b*, so that they allow the fine dirt to pass therethrough and to move toward the lower cover 220, without exerting influence on a force of fixing the height adjusting knob 310 by the fixing grooves 311*b*.

The supporting member 320 supports the suction brush 200 in contact with the inclined part 311 of the height adjusting knob 310, so that it allows the suction brush 200 to be ascended and descended by the inclined part 311. The supporting member 320 is protruded from the axle 260*a* of the second wheels 260.

Figure 6:
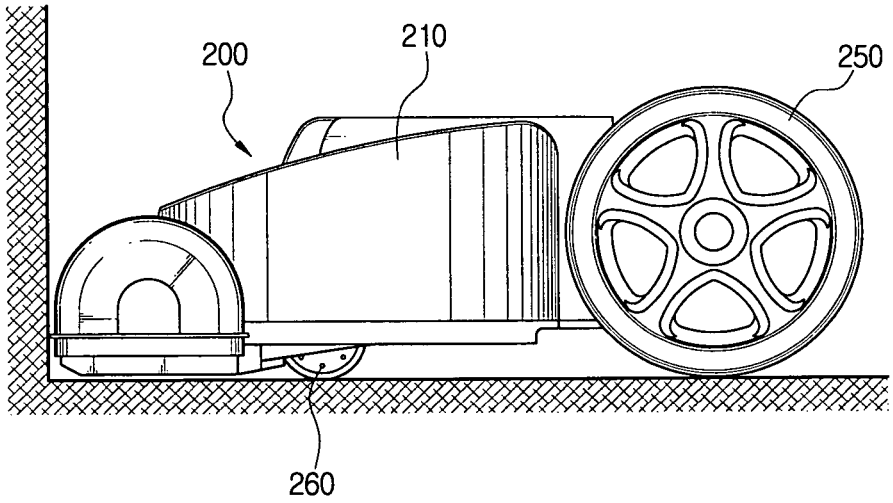
FIGS. 6 and 7 are views exemplifying an operation of the suction brush height adjusting apparatus in accordance with the exemplary embodiment of the present invention.
Figure 7:
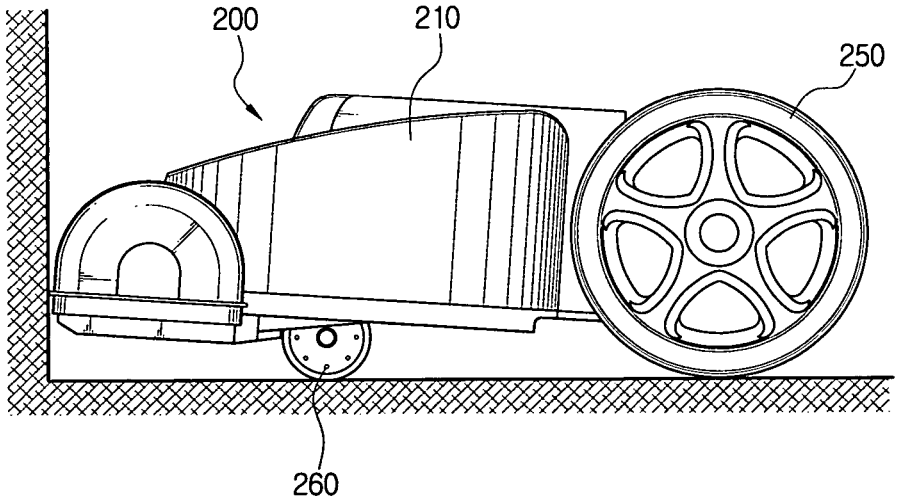

The supporting member 320 is engaged with one of the click grooves 311*a* of the inclined part 311. As illustrated in FIGS. 6 and 7, an ascending and descending range of the suction brush 200 is adjusted according to a position of the one click groove 311*a* with which the supporting member 320 is engaged.

Hereinafter, an operation of the suction brush height adjusting apparatus 300 of the vacuum cleaner in accordance with the exemplary embodiment of the present invention constructed as described above will be described in details.

As illustrated in FIGS. 1 and 2, when user moves the vacuum cleaner along a surface to be cleaned with griping the handle 111 while the suction brush 200 faces the surface to be cleaned, dirt is cleaned from the surface to be cleaned by a suction force generated in the cleaner body 100 and the brush member 240 rotated by the suction force.

At this time, if user want to adjust the distance between the suction brush 200 and the surface to be cleaned, he/she rotates the height adjusting knob 310 in directions of arrow A by using the operating part 312, as illustrated in FIG. 3. With the rotation of the height adjusting knob 310, the inclined part 311 also rotates, so that a position of one click groove 311*a* engaged with the supporting member 320 is changed.

To be more specific, if the supporting member 320 is positioned at a click groove 311*a* located at the beginning point h1 of the inclined part 311 illustrated in FIG. 4A, the suction brush 200 is descended, as illustrated in FIG. 6. Also, if the supporting member 320 is positioned at a click groove 311*a* located at the end point h2 of the inclined part 311, the suction brush 200 is ascended, as illustrated in FIG. 7.

On the other hand, fine dirt, such dust, scattering during the cleaning operation of the vacuum cleaner moves along the passing grooves 314 between the outer circumferential surface 310*a* of the height adjusting knob 310 and the inner circumferential surface 211*a* of the inserting groove 211 toward the lower cover 220.

Thus, the rotation of the height adjusting knob 310 is restricted or obstructed due to the fine dirt.

As apparent from the foregoing description, according to the suction brush height adjusting apparatus of the vacuum cleaner in accordance with the exemplary embodiment of the present invention, the passing grooves are formed as the passage through which the fine dirt taken in the narrow space between the height adjusting knob and the inserting hole or recess passes. Accordingly, the fine dirt is prevented from being tied up in the narrow space between the height adjusting knob and the inserting hole or recess. Thus, the rotation of the height adjusting knob is not restricted or obstructed due to the fine dirt, thereby the height adjusting apparatus being conveniently used.

The foregoing embodiment and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An apparatus for adjusting a height of a suction brush for use in a vacuum cleaner, comprising:

a height adjusting knob rotatably disposed in an inserting recess formed in the suction brush, the height adjusting knob having a flange protruding from an outer circumferential surface of the height adjusting knob to prevent the height adjusting knob from being removed from the inserting recess, an operating part to rotate the height adjusting knob, an inclined part formed thereon so that a height of the suction brush from a surface to be cleaned is varied as a position of the height adjusting knob is rotated, and at least one fixing groove formed in the outer circumferential surface of the height adjusting knob for fixing the rotating position thereof;

a supporting member to support the suction brush in contact with the inclined part so that the suction brush can be ascended and descended by the inclined part; and a passage disposed between an inner circumferential surface of the inserting recess and the outer circumferential surface of the height adjusting knob to pass fine dirt therethrough, the passage formed by a plurality of passing grooves formed in the outer circumferential surface of the height adjusting knob in a spaced-apart relation to each other and penetrating through the flange.

2. The apparatus as claimed in claim 1, wherein each of the passing grooves is formed in a straight line from a top to a bottom thereof.

3. The apparatus as claimed in claim 1, wherein the supporting member is disposed on an axle supporting wheels that are provided for moving the suction brush.

4. The apparatus as claimed in claim 1, wherein the inclined part has a plurality of click grooves formed in a spaced-apart relation to each other to regulate the rotation of the height adjusting knob.

5. The apparatus as claimed in claim 1, wherein the at least one fixing groove is formed in the outer circumferential surface of the height adjusting knob in at least one location between the plurality of passing grooves so that the at least one fixing groove is not aligned with any of the plurality of passing grooves.

6. A method for adjusting a height of a suction brush for use in a vacuum cleaner, comprising the steps of:

providing a height adjusting knob disposed in an inserting recess formed in the suction brush, the height adjusting knob having a flange protruding from an outer circumferential surface of the height adjusting knob to prevent the height adjusting knob from being removed from the inserting recess, an operating part to rotate the height adjusting knob, an inclined part formed thereon so that a height of the suction brush from a surface to be cleaned is varied as a position of the height adjusting knob is rotated, and at least one fixing groove formed in the outer circumferential surface of the height adjusting knob for fixing the rotating position thereof;

providing a supporting member to support the suction brush in contact with the inclined part of the height adjusting knob;

providing a passage disposed between an inner circumferential surface of the inserting recess and the outer circumferential surface of the height adjusting knob to allow fine dirt to pass therethrough so rotation of the height adjusting knob is not restricted or obstructed due to the fine dirt, the passage being formed by a plurality of passing grooves formed in the outer circumferential surface of the height adjusting knob in a spaced-apart relation to each other and penetrating through the flange; and rotating the operating part to rotate the height adjusting knob along the passing grooves to cause the suction brush to be at least one of ascended and descended by the inclined part.

7. The method as claimed in claim 6, wherein each of the passing grooves is formed in a straight line from a top to a bottom thereof.

8. The method as claimed in claim 6, wherein the at least one fixing groove is formed in the outer circumferential surface of the height adjusting knob in at least one location between the plurality of passing grooves so that the at least one fixing groove is not aligned with any of the plurality of passing grooves.

* * * * *